US006659178B2

(12) United States Patent
Wilson et al.

(10) Patent No.: US 6,659,178 B2
(45) Date of Patent: Dec. 9, 2003

(54) APPARATUS AND METHOD FOR SEALING WELL BORES AND BORE HOLES

(75) Inventors: Mary Jane Wilson, Bakersfield, CA (US); Jesse D. Frederick, Bakersfield, CA (US); Fredrick Woody, Bakersfield, CA (US)

(73) Assignee: WZI, Inc., Bakersfield, CA (US)

( * ) Notice: Subject to any disclaimer, the term of this patent is extended or adjusted under 35 U.S.C. 154(b) by 7 days.

(21) Appl. No.: 10/098,712

(22) Filed: Mar. 14, 2002

(65) Prior Publication Data

US 2003/0173092 A1 Sep. 18, 2003

(51) Int. Cl.[7] ..... E21B 33/13
(52) U.S. Cl. ..... 166/290; 166/298; 166/180
(58) Field of Search ..... 166/285, 290, 166/293, 292, 387, 180

(56) References Cited

U.S. PATENT DOCUMENTS

| | | | | |
|---|---|---|---|---|
| 4,736,796 A | | 4/1988 | Arnall | |
| 4,919,989 A | * | 4/1990 | Colangelo | 428/65 |
| 4,936,386 A | * | 6/1990 | Colangelo | 166/292 |
| 5,476,543 A | | 12/1995 | Ryan | |
| 5,611,400 A | | 3/1997 | James | |
| 5,657,822 A | | 8/1997 | James | |
| 5,810,085 A | | 9/1998 | James | |
| 6,279,655 B1 | | 8/2001 | Pafitis | |
| 2002/0096330 A1 | * | 7/2002 | James et al. | 166/292 |

OTHER PUBLICATIONS

Englehardt, John, et al., New Abandonment Technology New Materials and Placement Techniques, Society of Petroleum Engineers, Paper SPE 66 496 prepared for presentation at the SPE/EPA/DOE Exploration and Production Environmental Conference, San Antonio, TX Feb. 26–28, 2001.

* cited by examiner

*Primary Examiner*—William Neuder
(74) *Attorney, Agent, or Firm*—James M. Duncan

(57) ABSTRACT

A method and apparatus for sealing well bores is disclosed. The apparatus comprises plates which initially have a width smaller than the diameter of the well bore to be sealed or plugged. The plates are fabricated from a mineral substance which has the property of swelling into an expanded state upon contact with and absorption of a liquid. The apparatus further comprises means for placing the plate within the well bore. Among the mineral substances which may be utilized for forming the plate are members of the group of clay minerals known as smectites, including sodium montmorillonite, calcium montmorillonite, sodium bentonite, and calcium bentonite. A method sealing a well bore with the apparatus is disclosed.

63 Claims, 5 Drawing Sheets

APPARATUS AND METHOD FOR SEALING WELL BORES AND BORE HOLES

BACKGROUND OF THE INVENTION

The present invention generally relates to devices and methods for sealing well bores and bore holes, and more specifically to a method and apparatus which effectuates the sealing of well bores and bore holes through the use of mineral substances formed into compressed plates, where the compressed plates have the property of swelling into an expanded state upon contact with, and absorption of, a liquid. Among other applications, the disclosed method and apparatus may be used to seal off well bores and bore holes associated with the production, injection and/or disposal of water, hydrocarbons, and other fluids. The disclosed method and apparatus may also be utilized in the sealing of bore holes associated with the storage and/or disposal of nuclear materials. The terms well bore and bore hole are hereinafter used interchangeably and are intended to refer to any excavation which is deeper than the measurement across its opening.

Sealing or plugging a well bore may be required for a number of reasons, with each situation presenting different operational constraints. One common application of sealing or plugging a well bore occurs when a well is to be abandoned. Proper well abandonment is required to protect freshwater aquifers from fluid migration from other zones penetrated by the well bore. For example, in oil and gas wells, proper abandonment is necessary to prevent migration of fluids from a hydrocarbon zone to an adjacent freshwater zone. Proper abandonment is necessary to protect the freshwater aquifer and to confine hydrocarbons. Agencies which regulate oil and gas production typically require a cement plug, or plugs of other substances with adequate physical properties, to be placed across specified intervals for abandonment purposes. According to the usual regulatory requirements, the plug must extend from the total depth of the well or from at least one hundred feet below the bottom of each oil and gas zone to at least one hundred feet above the top of each oil or gas zone. In a cased well, all perforations are to be plugged and the plug is to extend at least 100 feet above the top of a landed liner, the uppermost perforations, the casing cementing point, the water shut-off holes, or the oil or gas zone, whichever is highest. An additional plug is required across fresh-saltwater interfaces. Fluids having the proper weight and consistency to prevent movement of other fluids into the well bore are placed across all intervals not otherwise plugged.

The most common method of sealing or plugging a well bore is pumping in a cement slurry to the zone of interest. However, depending upon the situation, design of an appropriate cement slurry can be complicated, requiring a number of different and expensive additives. Moreover, in the usual situation, a number of expensive resources must be assembled for the operation. Equipment such as a drilling rig, work-over unit, portable mast, pumping and blending works, bulk trucks, etc., and the personnel to operate the equipment, may be required to stand by during the course of the operation. The equipment and personnel may continue to stand by even after application of the cement slurry has concluded, waiting for the cement to harden to an acceptable strength.

Another known disadvantage of cement is that it can degrade over time, such that it might contract or crack, thereby providing channels through which fluid migration might take place. Even without such degradation, cement is known to have some permeability, potentially allowing fluid flow through a cement plug.

As an alternative to using cement as a plugging or sealing material, it is known to use high quality course ground chemically unaltered sodium bentonite (hereinafter referred to as sodium bentonite). Sodium bentonite is the name given to clay containing over 90% sodium montmorillonite, one of several minerals within the smectite group. These substances exhibit pronounced swelling tendencies when exposed to a hydrating liquid. Sodium bentonite has long been identified as a material with excellent plugging ability. Dry sodium bentonite will swell to a size ten to twenty-five times its dry state when hydrated. Hydrated sodium bentonite has extremely low permeability, a much-desired characteristic for an isolation plug. It has long been identified as a suitable material for plugging monitoring wells, seismic shot holes, mining shafts, exploratory holes, water wells, and oil and gas wells. Sodium bentonite has also been identified as an excellent plugging material for high-level nuclear waste repositories because of its ability to confine waste migration and resist alteration over time.

A simple method is known for using sodium bentonite to create a plug in a well bore. This method comprises simply pouring a small granular form of dry sodium bentonite into the well bore from the surface, filling the hole from the bottom upward. However, sodium bentonite in granular form (having a diameter of no greater than ⅜ inches) will swell quickly upon encountering water or other liquids. As sodium bentonite hydrates and expands, its density decreases, resulting in a reduced falling velocity and increased exposure to well bore liquids before reaching the desired depth. This characteristic of the granular form of sodium bentonite creates a risk that the material will bridge and plug off the well before a plug is achieved at the desired depth. Therefore, the use of finely ground sodium bentonite is generally limited to shallow well bores up to 100 feet in depth. This material might also be used in a deeper well bore containing very little liquid.

Because of the risk of bridging off, alternative placement methods for sodium bentonite have been proposed. In one method, bentonite is poured from the surface while rotating an auger drill within the well to force the bentonite downward into the well. In another method, bentonite chips are encapsulated and poured into the well from the surface. It is also known to use chemically unaltered compressed sodium bentonite nodules, which are poured from the surface and, ideally, fall to the intended plugging zone where they accumulate until the desired plug height is reached. The nodules are typically manufactured from roll type briquetting and compacting machines. Compression of the nodule reduces the hydration and expansion rates typical of uncompressed sodium bentonite, allowing use of this material in deeper applications. However, all of these methods continue to rely upon surface pouring the sodium bentonite into the well. Notwithstanding improvements offered by these methods, there remains a potential for the material to bridge off above the desired depth of the plug, particularly where there is an excessive pour rate. Well bore irregularities, obstructions, extreme directional changes, fluid interfaces, viscous emulsions, and other common well bore occurrences may cause the initially poured grains, capsules or nodules to decelerate. Subsequently poured sodium bentonite may catch up with the initial material, causing the grains, capsules or nodules to congregate, and ultimately to bridge.

Nodules may present a further disadvantage. Depending upon how the nodules are packaged and delivered to the well site, sodium bentonite residue may accumulate from nodule-to-nodule contact. If this residue is included in the surface pour, the residue will begin to hydrate almost immediately upon contact with well liquids, thereby increasing the liquid viscosity and decreasing the velocity of the surrounding nodules. It is also possible for nodule-to-nodule contact to take place during the surface pour or as the nodules are falling into place within the well bore, which once again can generate sodium bentonite residue resulting in an increase in the liquid viscosity.

Another disadvantage of surface pouring sodium bentonite grains, capsules or nodules is that forming a plug by surface pouring these materials is limited to generally vertical wells. These materials will tend to collect or bridge in highly deviated and/or horizontal well bores, rendering it unlikely that the lateral portion of the well bore can be effectively plugged.

SUMMARY OF THE INVENTION

The present invention is directed to an apparatus and method for sealing well bores and bore holes which meets the needs identified above. The apparatus comprises a first plate having a top surface, a bottom surface, and a peripheral edge surface bound by the top surface and the bottom surface. The peripheral edge surface has a maximum width defined by the linear distance between a first point on the peripheral edge surface to an opposite second point on the peripheral edge surface. The plate has a first compressed state wherein the maximum width is smaller than the diameter of the well bore or the bore hole to be sealed. The plate is formed from a mineral substance. This mineral substance has the property of swelling into a second expanded state upon contact with a liquid and absorption of that liquid. The apparatus requires means for placing the plate within the well bore or bore hole. Among the mineral substances which may be utilized for forming the plate are members of the group of clay minerals known as smectites, including sodium montmorillonite, calcium montmorillonite, sodium bentonite and calcium bentonite.

In one embodiment the plate may be round. For this embodiment, the plate has a first compressed state wherein the plate has a diameter smaller than the diameter of the well bore.

A method of sealing well bores and bore holes is also disclosed. The method comprises the steps of first disposing a mineral substance into a mold, where the substance has the property of swelling upon contact with a liquid and absorption of the liquid. The mineral substance is then molded into a plate, where the plate has a top surface, a bottom surface, and a peripheral edge surface bound by the top surface and the bottom surface. The peripheral edge surface has a maximum width defined by the linear distance between a first point on the peripheral edge surface to an opposite second point on the peripheral edge surface. The plate is compressed into a first compressed state where the maximum width is smaller than the diameter of the well bore. The plate is thereafter placed into the well bore with placement means. The plate is thereafter exposed to liquid such that the mineral substance swells into a second expanded state upon contact with the liquid and absorption of the liquid.

These and other features, aspects, and advantages of the present invention will become better understood with regard to the following description, appended claims, and accompanying drawings.

DETAILED DESCRIPTION OF THE EMBODIMENTS

Figures 1, 2, 3, 4:
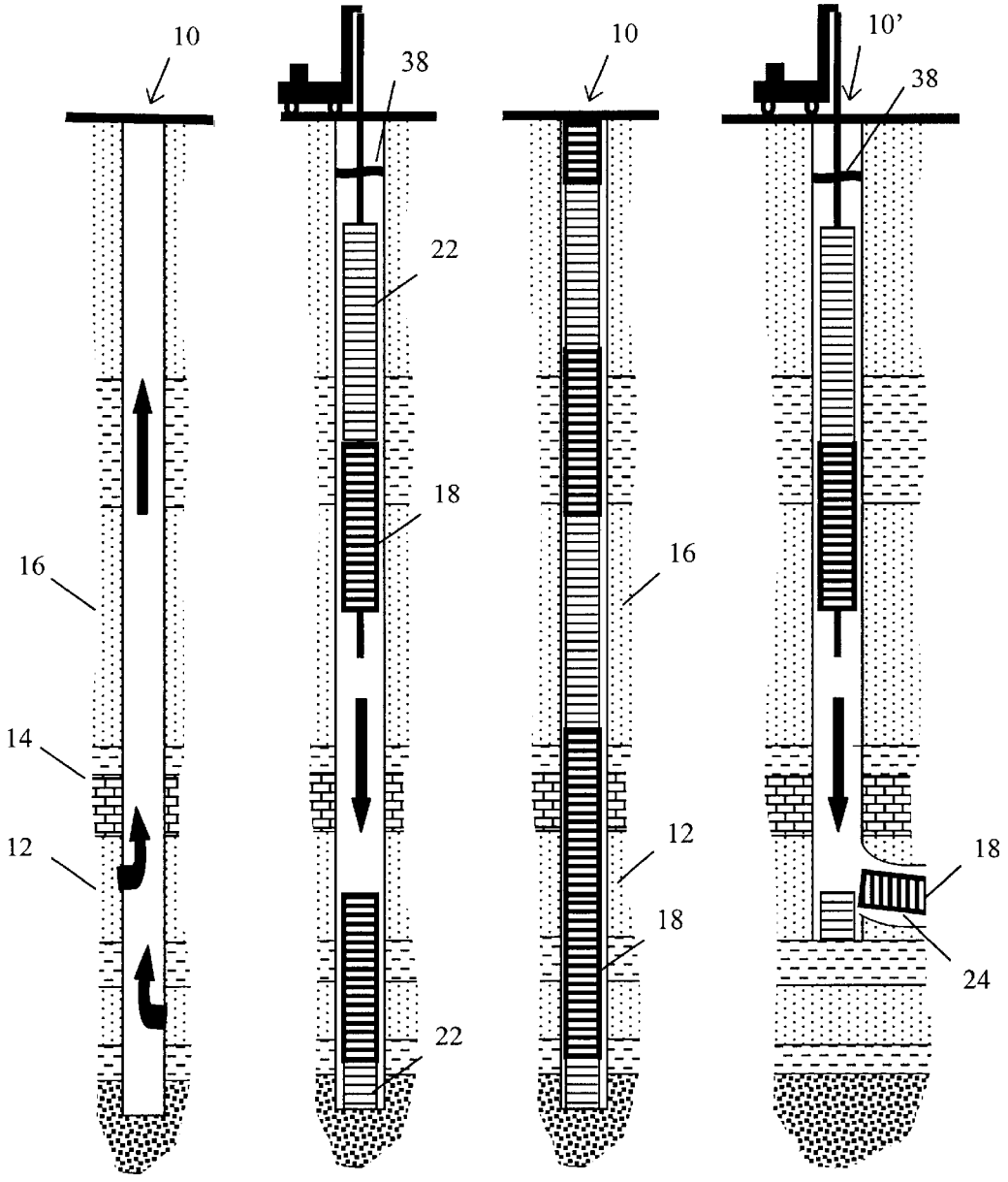
FIG. 1 is a schematic showing down-hole zones producing into a well bore.
FIG. 2 shows the setting of one embodiment of the disclosed apparatus and method.
FIG. 3 shows the configuration of the well bore after placement of one embodiment of the disclosed apparatus.
FIG. 4 shows the setting of one embodiment of the disclosed apparatus and method in a well bore having a deviated section.

Referring now specifically to the drawings, FIG. 1 shows well bore 10 into which fluids are flowing from a producing zone 12. Within the same well bore 10, there may exist cap rock zones 14 which have such low permeability that the cap rock zone 14 effectively contains fluids within the producing zone 12 except for fluids which flow from the producing zone 12 into the well bore 10. Shale, claystone, and other fine-grained sediments are typical cap rocks. However, once well bore 10 has been drilled or excavated, a conduit has been created by which fluids from the producing zone 12 may flow around the cap rock zone 14 and flow into other permeable zones, including fresh water zone 16. If producing zone 12 contains hydrocarbons, salt water, or other mineral substances, it is obvious that well bore 10 might provide a conduit for flow of those substances into a fresh water zone 16, resulting in the contamination of the fresh water. The well bore 10 must be designed to prevent such flow from adjacent zones into fresh water zones, and various governmental agencies oversee the design, operation, and abandonment of well bores to insure reasonable precautions are taken to prevent the flow of contaminants into fresh water zones. In the case of hydrocarbon wells, the well bore 10 is typically lined with steel casing, and a cement sheath is installed around the casing in the annular space between the rock face and the casing. The casing and cement sheath are thereafter perforated to provide flow channels from the producing zone 12 into the well bore 10. Ideally, the cement sheath forms an effective seal between the casing and the cap rock zone 14, thereby preventing fluids to flow up through the casing-open hole annulus from the producing zone 12 into the fresh water zone 16. In addition, regulatory agencies usually require the operators of hydrocarbon wells to demonstrate the existence of an effective "water shut-off" directly below known fresh water zones, to show that the fresh water zone has been safely isolated from fluids produced from lower zones.

For a number of different operational reasons, including abandonment of a producing zone 12, it is often necessary to seal or plug off the producing zone 12. In the past, the plugs have generally been composed of cement. However, for the reasons described above, it is advantageous to use other substances for plug materials, including mineral substances which swell upon contact with and adsorption of liquids, such as members of the group of clay minerals known as smectites, including sodium montmorillonite, calcium montmorillonite, sodium bentonite and calcium bentonite.

The disclosed method and apparatus utilize plates made from these substances. As shown in FIG. 2, compressed plates 18 made from these materials are inserted into the well bore 10 with means for placing the plate 18 within the well bore 10, such as wireline, tubing strings, coiled tubing or sucker rod strings. FIG. 3 depicts the well bore 10 when compressed plates 18 have been set adjacent to each producing zone 12, and fresh water zone 16. FIG. 3 also depicts compressed plates 18 being set adjacent to the cap rock zone 14. Once the compressed plates 18 are in place within the well bore 10, the liquids within the well bore will begin to hydrate the compressed plates, such that the plates 18 swell into a second expanded state. If necessary, liquid may be introduced into the well bore to initially hydrate the compressed plates 18. The plates 18 should hydrate within 24 hours. Referring once again to FIG. 3, it is to be appreciated that once the pressure plates hydrate and expand within the well bore 10, the fresh water zone 16 will effectively be isolated from the producing zone 12.

FIG. 4 depicts a well bore 10' which has a segment 24 which deviates substantially from vertical. Deviated and horizontal wells present a situation where a surface pour of any material, including sodium bentonite, is not an appropriate method of creating a plug because materials can not be effectively placed within the deviated segment 24, and will not effectively seal off the deviated segment because the materials will gravitate to the bottom of the well bore 10'. However, the disclosed apparatus may be successfully applied in these situations, because the plates 18 conform to the orientation of the deviated segment 24. As shown in FIG. 4, compressed plates 18 are installed with means for placing the plates within the well bore 10'. Where the plates 18 are to be installed in a deviated segment 24 of a well bore 10', the placement means must be a tubing string, sucker rod string, coiled tubing, or some other device capable of being placed into compression to push the stack of plates 18 into the deviated segment. It is to be appreciated that wireline is not an acceptable placement means for installing plates 18 into the deviated segment 24.

In addition to the compressed plates 18, spacers 22 made from filler material may be installed adjacent to the compressed plates 18. While the spacers 22 may be made out of the same materials used to fabricate the compressed plates 18, the spacers 22 may also be made from fuller's earth, Portland cement, silica sand, mica, diatomaceous earth, and different combinations thereof. The spacers 22 may be installed in the well bore 10 adjacent to the compressed plates 18. As depicted in FIG. 2 and FIG. 3, the spacers 22 may be run ahead of the compressed plates 18 to form a base for the compressed plates to rest upon. The spacers 22 may also lend additional lateral support to the well bore 10, but still allow liquids to flow around the spacers so that the plates 18 remain hydrated. If the plates 18 become dehydrated, they may no longer form an effective seal.

Figure 5A:
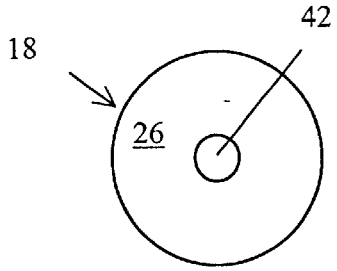
FIG. 5A shows a top view of a plate used in the disclosed method and apparatus.
Figure 6A:
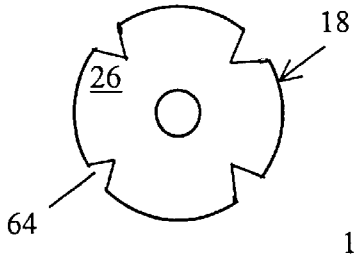
FIG. 6A shows a top view of an alternative embodiment of a plate used in the disclosed method and apparatus, the plate having grooves in the peripheral edge surface.
Figure 5B:
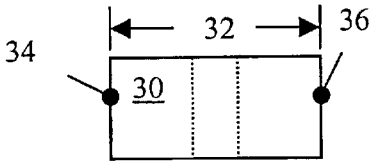
FIG. 5B shows a side view of a plate used in the disclosed method and apparatus.
Figure 6B:
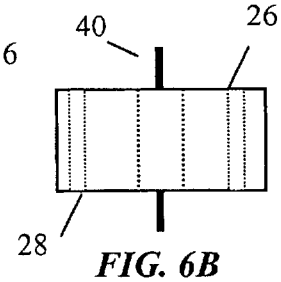
FIG. 6B shows a side view of an alternative embodiment of a plate used in the disclosed method and apparatus.
Figure 5C:
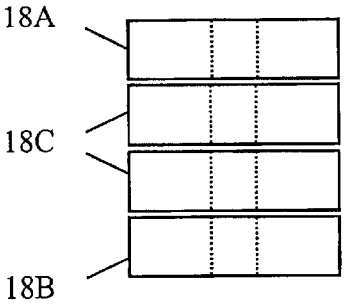
FIG. 5C shows a side view of a stack of plates used in the disclosed method and apparatus.
Figure 6C:
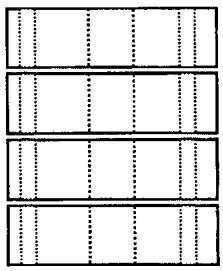
FIG. 6C shows a side view of an alternative embodiment of a stack of plates used in the disclosed method and apparatus.

As shown in FIGS. 5(A–C) through 10(A–C), compressed plate 18 has a top surface 26, a bottom surface 28, and a peripheral edge surface 30. The peripheral edge surface 30 has a maximum width 32 defined by the linear distance between a first point 34 on the peripheral edge surface 30 to an opposite second point 36 on the peripheral edge surface. The compressed plate 18 has a first compressed state in which the maximum width 32 is smaller than the diameter of the well bore 10. The compressed plate 18 is formed from a mineral substance which has the property of swelling into a second expanded state upon contact with and absorption of a liquid 38 within the well bore 10. Mineral substances which have been found to include these properties include the group of clay minerals known as smectites. Among these clay minerals are sodium montmorillonite and calcium montmorillonite. Sodium bentonite, which is the trade name given to clay containing over 90% sodium montmorillonite, exhibits distinct swelling tendencies and is an appropriate mineral substance for the fabrication of the plates. When sodium bentonite is used as the mineral substance for fabrication of the compressed plate 18, the sodium bentonite should be finely ground and chemically unaltered. The sodium bentonite will have a moisture content of approximately 6 percent to 10 percent. Calcium bentonite also exhibits some swelling tendencies, but these tendencies are not as pronounced as with sodium bentonite. Therefore, application of the apparatus with plates 18 fabricated from calcium bentonite may be more limited than plates 18 made with sodium bentonite.

The mineral substance is then press molded into a plate form such as those depicted in FIGS. 5(A–C) through 10(A–C). A dry pressing method may be used for forming the compressed plates 18. This process is used for forming many types of ceramic products, including tiles. However, the term "dry pressing" is not strictly accurate because the materials being pressed may contain from 3% to 15% water. Pressures used in dry pressing vary from a few hundred psi to 100,000 psi depending upon the material being compacted, the shape of the plate, and the quality necessary for the particular design requirements for the compressed plates 18. Pressing is usually accomplished in steel dies using either hydraulic or mechanical means of producing the desired pressures.

One acceptable process for forming the compressed plates is through a method called high pressure jolt squeeze technology. In this process, the mineral substance is placed, in dry form, within a mold, such as that used for pressing tiles. The material is subjected to high pressure compression through the process, which acts to consolidate and bind the dry material together into the desired shape.

Figure 12:
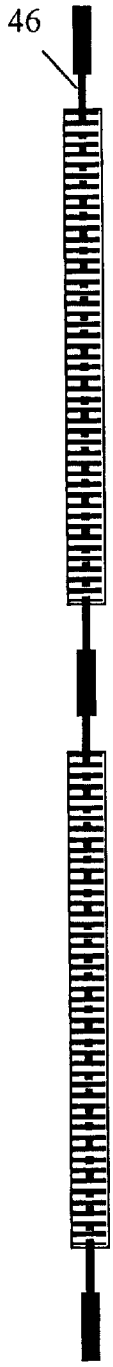
FIG. 12 shows alternative means for placement of a stack of plates.
Figure 13:
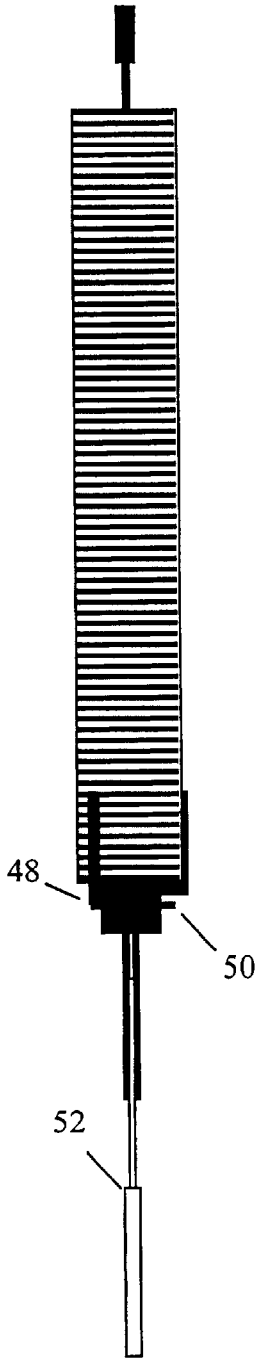
FIG. 13 shows alternative means for placement of a stack of plates.
Figure 14:
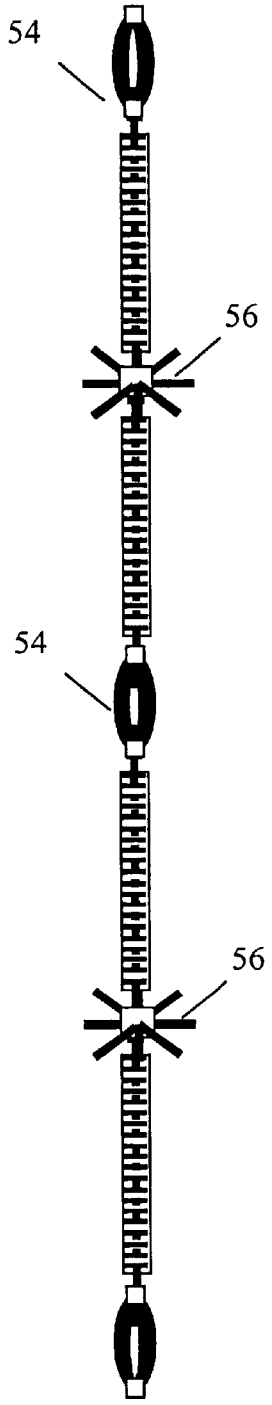
FIG. 14 shows alternative means for placement of a stack of plates.

The plate 18 may be fabricated such that top surface 26 and bottom surface 28 are centered relative to a vertical axis 40. A bore 42 may be placed in the plate 18 such that the bore 42 extends from the top surface 26 to the bottom surface 28, with the bore 42 centered relative to the vertical axis 40. A mandrel 44, fabricated from tubing, rods or other round stock, may then be inserted through the bore 42, such that the plate 18 may be placed within the well bore 10 by connecting the mandrel to a tubing and/or rod string 46 as depicted in FIG. 12. Using this means of placing the plate 18 into the well bore 10, a plate retainer assembly 48 equipped with shear pin 50 may be attached to the mandrel 44 as shown in FIG. 13. Jars 52 may also be used for breaking shear pin 50 so that the tubing or rod string 46 is released from the plate 18. FIG. 14 shows an alternative assembly for inserting plate 18 into the well bore, which also includes centralizers 54 and scratchers 56, which may be reciprocated within the well bore to remove oil or other debris from the well bore 10 before the plates 18 are hydrated.

Figure 15:
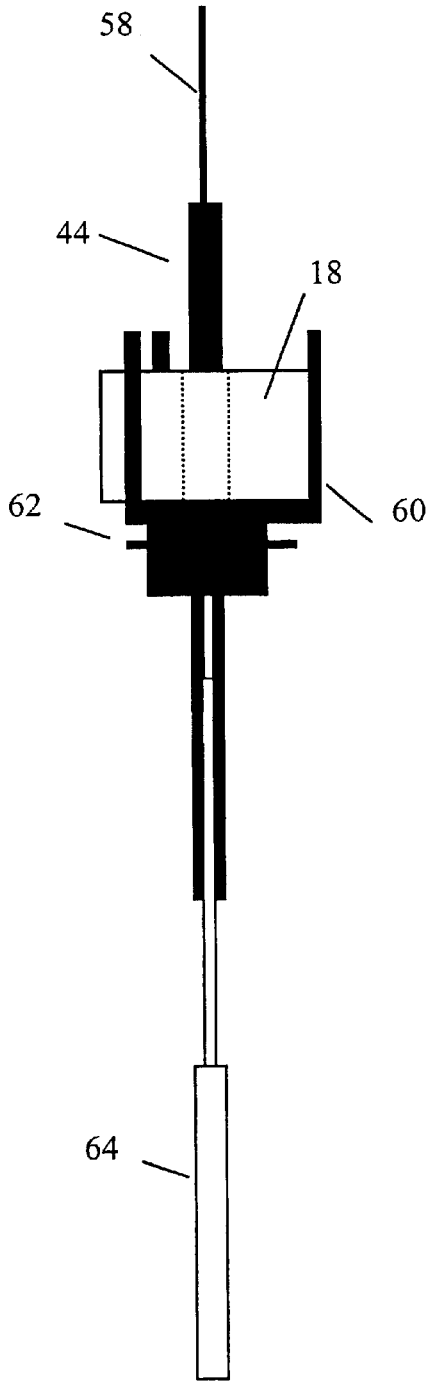
FIG. 15 shows alternative means for placement of a stack of plates.

Alternatively, the mandrel 44 may be connected to a wireline 58 as depicted in FIG. 15 for placing the plate 18 within the well bore 10. A wireline plate retainer assembly 60 equipped with a shear pin 62 may be attached to the mandrel 44. Wireline jars 64 may be used for breaking shear pin 62 so that the wireline 58 is released from the plate 18.

The plate 18 may be round, as shown in FIG. 5A. Where round plates are used, the plate must have a first compressed state where the diameter 32 of the plate is smaller than the diameter of the well bore.

The disclosed method and apparatus may use a compressed plate 18 or multiple compressed plates. As shown in FIGS. 5(A–C) through 10(A–C) when multiple compressed plates 18 are applied to a well bore 10, the plates may be arranged such that there is a first plate 18A, a second plate 18B, and a plurality of intermediate plates 18C. As with a single plate installation, in the multiple plate installation each plate has a top surface 26, a bottom surface 28, and a peripheral edge surface 30 bound by the top surface 26 and the bottom surface 28. The peripheral edge surface 30 continues to have a maximum width 32 defined by the linear distance between a first point 34 on the peripheral edge surface to an opposite second point 36 on the peripheral edge surface. The first plate 18A is at a top position, the second plate 18B is at a bottom position, and the intermediate plates 18C are stacked between the first plate 18A and the second plate 18B.

Figure 7A:
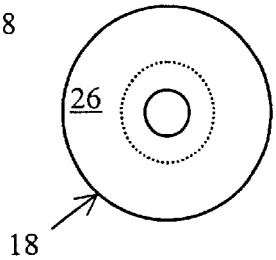
FIG. 7A shows a top view of an alternative embodiment of a plate used in the disclosed method and apparatus, the plate having ridges and grooves in the top surface and bottom surface.
Figure 7B:
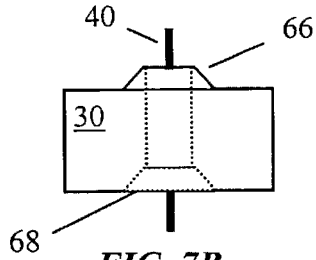
FIG. 7B shows a side view of an alternative embodiment of a plate used in the disclosed method and apparatus, the plate having ridges and grooves in the top surface and bottom surface.
Figure 7C:
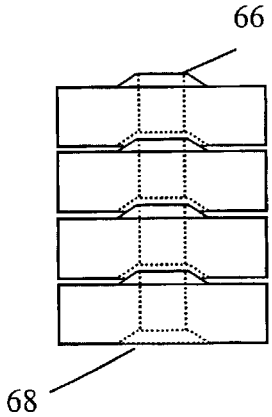
FIG. 7C shows a side view of an alternative embodiment of a stack of plates used in the disclosed method and apparatus, the plates having ridges and grooves in the top surface and bottom surface.
Figure 8A:
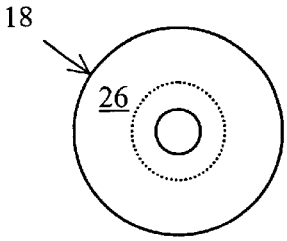
FIG. 8A shows a top view of an alternative embodiment of a plate used in the disclosed method and apparatus, the plate having a convex top surface and a concave bottom surface.
Figure 9A:
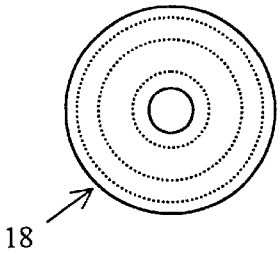
FIG. 9A shows a top view of an alternative embodiment of a plate used in the disclosed method and apparatus, the plate having ridges and grooves in the top surface and bottom surface.
Figure 10A:
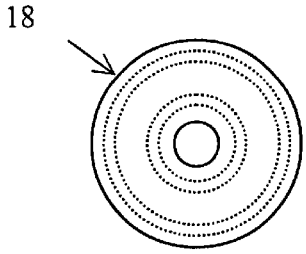
FIG. 10A shows a top view of an alternative embodiment of a plate used in the disclosed method and apparatus, the plate having ridges and grooves in the top surface and bottom surface.
Figure 8B:
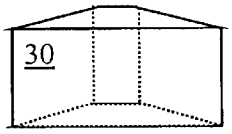
FIG. 8B shows a side view of an alternative embodiment of a plate used in the disclosed method and apparatus, the plate having a convex top surface and a concave bottom surface.
Figure 9B:
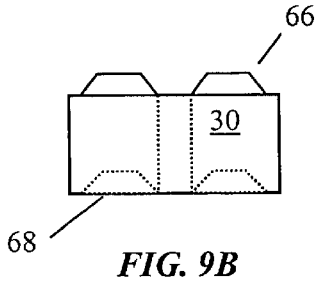
FIG. 9B shows a side view of an alternative embodiment of a plate used in the disclosed method and apparatus, the plate having ridges and grooves in the top surface and bottom surface.
Figure 10B:
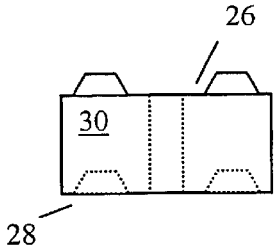
FIG. 10B shows a side view of an alternative embodiment of a plate used in the disclosed method and apparatus, the plate having ridges and grooves in the top surface and bottom surface.
Figure 8C:
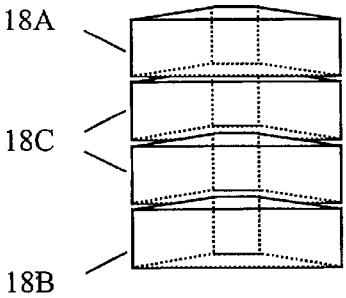
FIG. 8C shows a side view of an alternative embodiment of a stack of plates used in the disclosed method and apparatus, the plates having convex top surfaces and concave bottom surfaces.
Figure 9C:
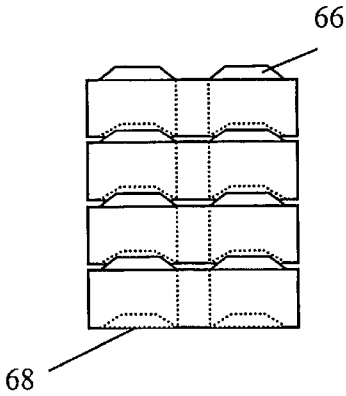
FIG. 9C shows a side view of an alternative embodiment of a stack of plates used in the disclosed method and apparatus, the plates having ridges and grooves in the top surface and bottom surface.
Figure 10C:
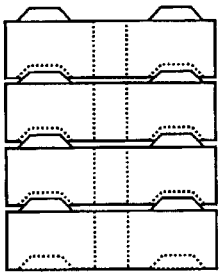
FIG. 10C shows a side view of an alternative embodiment of a stack of plates used in the disclosed method and apparatus, the plates having ridges and grooves in the top surface and bottom surface.
Figure 11:
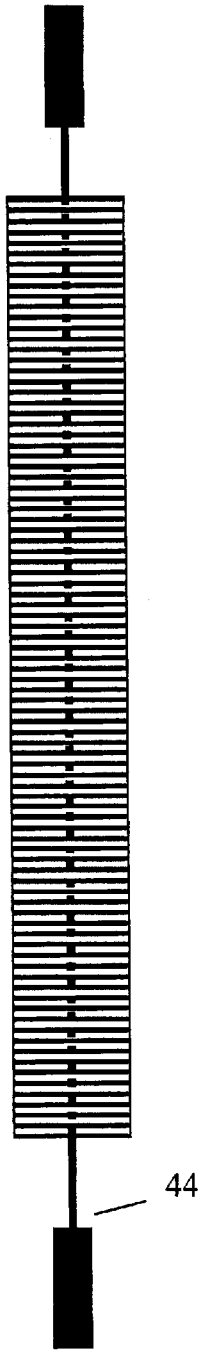
FIG. 11 shows alternative means for placement of a stack of plates.

As shown in FIGS. 5(A–C) through 10(A–C), the top surface 26 of each intermediate plate 18C is configured to mate with the bottom surface 28 of the adjacent plate. It is to be appreciated that the combinations of mating surfaces which might be used is practically limitless. The mating surfaces may assist the plates 18 in forming a more consolidated plug. As shown in FIGS. 7(A–C), 9(A–C) and 10(A–C), the mating surfaces may include a ridge 66 on the top surface 26 with a corresponding groove 68 on the bottom surface 28 convex adapted to receive the ridge 66 of an underlying plate. The top surface 26 might also be concave and the bottom surface 28, where the bottom surface 28 is adapted to receive the top surface of an underlying plate. Likewise, as shown in FIG. 8, the top surface 26 might be convex and the bottom surface 28 concave, where the bottom surface is adapted to receive the top surface of an underlying plate.

The peripheral edge surface 30 may also have slots 64, which allow liquid bypass as the plate 18 is lowered into the well bore 10.

While the above is a description of various embodiments of the present invention, further modifications may be employed without departing from the spirit and scope of the present invention. For example, the size, shape, position and/or material of the various components may be changed as desired. Thus the scope of the invention should not be limited by the specific structures disclosed. Instead the true scope of the invention should be determined by the following claims.

What is claimed is:

1. An apparatus for sealing a well bore lined with casing comprising:

(a) a first plate having a top surface, a bottom surface, and a peripheral edge surface bound by the top surface and the bottom surface, wherein the top surface and bottom surface are centered relative to a vertical axis, wherein the plate has a bore extending from the top surface to the bottom surface, the bore centered relative to the vertical axis, the peripheral edge surface having a maximum width defined by the linear distance between a first point on the peripheral edge surface to an opposite second point on the peripheral edge surface;

(b) the plate having a first compressed state wherein the maximum width is smaller than the diameter of the casing;

(c) the plate being formed from a mineral substance, the substance having the property of swelling into a second expanded state upon contact with a liquid and absorption of the liquid; and (d) means for placing the plate within the casing.

2.The apparatus of claim 1 wherein the mineral substance comprises a member of the group of clay minerals known as smectites.

3. The apparatus of claim 1 wherein the mineral substance comprises sodium montmorillonite.

4. The apparatus of claim 1 wherein the mineral substance comprises sodium bentonite.

5. The apparatus of claim 1 wherein the mineral substance comprises calcium bentonite.

6. The apparatus of claim 1 wherein the plate is molded into the first compressed state through the use of high pressure jolt squeeze technology.

7. The apparatus of claim 1 wherein the means for placing the plate within the casing comprises a mandrel inserted through the bore, wherein the mandrel is connected to a wireline.

8. The apparatus of claim 1 wherein the means for placing the plate within the casing comprises a mandrel inserted through the bore, wherein the mandrel is connected to a string of tubing.

9. The apparatus of claim 1 wherein the means for placing the plate within the casing comprises a mandrel inserted through the bore, wherein the mandrel is connected to a string of sucker rods.

10. An apparatus for sealing a well bore lined with casing comprising;

(a) a first round plate having a top surface and a bottom surface, (b) the plate having a first compressed state wherein the plate has a diameter smaller than the diameter of the casing;

(c) the plate being formed from a mineral substance, the substance having the property of swelling into a second expanded state upon contact with a liquid and absorption of the liquid; and (d) means for placing the plate within the casing.

11. The apparatus of claim 10 wherein the mineral substance comprises a member of the group of clay minerals known as smectites.

12. The apparatus of claim 10 wherein the mineral substance comprises sodium montmorillonite.

13. The apparatus of claim 10 wherein the mineral substance comprises sodium bentonite.

14. The apparatus of claim 10 wherein the mineral substance comprises calcium bentonite.

15. The apparatus of claim 10 wherein the plate is molded into the first compressed state through the use of high pressure jolt squeeze technology.

16. The apparatus of claim 10 wherein the plate has a peripheral edge surface bound by the top surface and the bottom surface.

17. The apparatus of claim 16 wherein the peripheral edge surface has at least one slot extending from the top surface to the bottom surface.

18. The apparatus of claim 10 wherein the top surface and bottom surface are centered relative to a vertical axis.

19. The apparatus of claim 18 wherein the plate has a bore extending from the top surface to the bottom surface, the bore centered relative to the vertical axis.

20. An apparatus for sealing a well bore lined with casing comprising;

(a) a first plate, a second plate, and a plurality of intermediate plates, each plate having a top surface, a bottom surface, and a peripheral edge surface bound by the top surface and the bottom surface, the peripheral edge surface having a maximum width defined by the linear distance between a first point on the peripheral edge surface to an opposite second point on the peripheral edge surface, a top surface and a bottom surface, the first plate at a top position, the second plate at a bottom position, and the intermediate plates stacked between the first plate and the second plate;

(b) each plate having a first compressed state wherein the maximum width is smaller than the diameter of the casing;

(c) each plate being formed from a mineral substance, the substance having the property of swelling into a second expanded state upon contact with a liquid and absorption of the liquid; and (d) means for placing the first plate, the second plate and the plurality of intermediate plates within the casing.

21. The apparatus of claim 20 wherein the top surface of each intermediate plate is configured to mate with the bottom surface of the adjacent plate.

22. The apparatus of claim 20 wherein the top surface of the plates has a ridge and the bottom surface of the plates has a groove adapted to receive the ridge of an underlying plate.

23. The apparatus of claim 20 wherein the top surface of the plates is concave and the bottom surface of the plates is convex, said bottom surface adapted to receive the top surface of an underlying plate.

24. The apparatus of claim 20 wherein the top surface of the plates is convex and the bottom surface of the plates is concave, said bottom surface adapted to receive the top surface of an underlying plate.

25. The apparatus of claim 20 wherein the top surface and bottom surface of each plate are centered relative to a vertical axis.

26. The apparatus of claim 25 wherein each plate has a bore extending from the top surface to the bottom surface, the bore centered relative to the vertical axis.

27. The apparatus of claim 26 wherein the means for placing the plates within the casing comprises a mandrel inserted through the bore of each plate, wherein the mandrel is connected to a wireline.

28. The apparatus of claim 26 wherein the means for placing the plates within the casing comprises a mandrel inserted through the bore of each plate, wherein the mandrel is connected to a string of tubing.

29. The apparatus of claim 26 wherein the means for placing the plates within the casing comprises a mandrel inserted through the bore of each plate, wherein the mandrel is connected to a string of sucker rods.

30. An apparatus for sealing a well bore lined with casing comprising;

(a) a first round plate, a second round plate, and a plurality of intermediate round plates, each plate having a top surface and a bottom surface, the first plate at a top position, the second plate at a bottom position, and the intermediate plates stacked between the first plate and the second plate;

(b) each plate having a first compressed state wherein the plate has a diameter smaller than the diameter of the casing;

(c) each plate being formed from a mineral substance, the substance having the property of swelling into a second expanded state upon contact with a liquid and absorption of the liquid; and (d) means for placing the first plate, the second plate and the plurality of intermediate plates within the casing.

31. A method of sealing a well bore lined with casing, the method comprising the steps of:

(a) disposing a mineral substance into a mold, the substance having the property of swelling upon contact with a liquid and absorption of the liquid;

(b) molding the mineral substance into a plate, the plate having a top surface, a bottom surface, and a peripheral edge surface bound by the top surface and the bottom surface, the peripheral edge surface having a maximum width defined by the linear distance between a first point on the peripheral edge surface to an opposite second point on the peripheral edge surface;

(c) compressing the plate into a first compressed state wherein the maximum width is smaller than the diameter of the casing;

(d) placing the plate into the cased well bore with placement means; and (e) exposing the plate to liquid, whereby the mineral substance swells into a second expanded state upon contact with the liquid and absorption of the liquid.

32. The method of claim 31 wherein the mineral substance comprises a member of the group of clay minerals known as smectites.

33. The method of claim 31 wherein the mineral substance comprises sodium montmorillonite.

34. The method of claim 31 wherein the mineral substance comprises sodium bentonite.

35. The method of claim 31 wherein the mineral substance comprises calcium bentonite.

36. The method of claim 31 wherein the plate is compressed with high pressure jolt squeeze technology.

37. The method of claim 31 wherein the top surface and bottom surface of the plate are centered relative to a vertical axis.

38. The method of claim 37 wherein the plate has a bore extending from the top surface to the bottom surface, the bore centered relative to the vertical axis.

39. The method of claim 38 wherein the placement means comprises a mandrel inserted through the bore of the plate, wherein the mandrel is connected to a wireline.

40. The method of claim 38 wherein the placement means comprises a mandrel inserted through the bore of the plate, wherein the mandrel is connected to a string of tubing.

41. The method of claim 38 wherein the placement means comprises a mandrel inserted through the bore of the plate, wherein the mandrel is connected to a string of sucker rods.

42. A method of sealing a well bore lined with casing, the method comprising the steps of:

(a) disposing a mineral substance into a mold, the substance having the property of swelling upon contact with a liquid and absorption of the liquid;

(b) molding the mineral substance into a round plate, the plate having a top surface and a bottom surface;

(c) compressing the plate into a first compressed state wherein the diameter of the plate is smaller than the diameter of the casing;

(d) placing the plate into the cased well bore with placement means; and (e) exposing the plate to liquid, whereby the mineral substance swells into a second expanded state upon contact with the liquid and absorption of the liquid.

43. A method of sealing a well bore lined with casing, the method comprising the steps of:

(a) disposing a mineral substance into a mold, the substance having the property of swelling upon contact with a liquid and absorption of the liquid;

(b) molding the mineral substance into a first plate, a second plate, and a plurality of intermediate plates, each plate having a top surface, a bottom surface, and a peripheral edge surface bound by the top surface and the bottom surface, the peripheral edge surface having a maximum width defined by the linear distance between a first point on the peripheral edge surface to an opposite second point on the peripheral edge surface;

(c) compressing the first plate, the second plate and the intermediate plates into a first compressed state wherein the maximum width of each plate is smaller than the diameter of the casing;

(d) assembling the first plate at a top position, the second plate at a bottom position, and the plurality of intermediate plates stacked between the first plate and the second plate;

(e) means for placing the plates into the casing; and (f) exposing the plates to liquid, whereby the mineral substance swells into a second expanded state upon contact with the liquid and absorption of the liquid.

44. A method of sealing a well bore lined with casing, the method comprising the steps of:

(a) disposing a mineral substance into a mold, the substance having the property of swelling upon contact with a liquid and absorption of the liquid;

(b) molding the mineral substance into a first round plate, a second round plate, and a plurality of intermediate round plates, each plate having a top surface and a bottom surface;

(c) compressing the first plate, the second plate and the intermediate plates into a first compressed state wherein the maximum diameter of each plate is smaller than the diameter of the casing;

(d) assembling the first plate at a top position, the second plate at a bottom position, and the plurality of intermediate plates stacked between the first plate and the second plate;

(e) means for placing the plates into the cased well bore; and (f) exposing the plates to liquid, whereby the mineral substance swells into a second expanded state upon contact with the liquid and absorption of the liquid.

45. An apparatus for sealing a well bore lined with casing comprising;

(a) a first group of plates comprising a first plate, a second plate, and a plurality of intermediate plates, each plate of the first group having a top surface, a bottom surface, and a peripheral edge surface bound by the top surface and the bottom surface, the peripheral edge surface having a maximum width defined by the linear distance between a first point on the peripheral edge surface to an opposite second point on the peripheral edge surface, a top surface and a bottom surface, the first plate at a top position, the second plate at a bottom position, and the intermediate plates stacked between the first plate and the second plate;

(b) a second group of plates comprising a third plate, a fourth plate, and a plurality of intermediate plates, each plate of the second group having a top surface, a bottom surface, and a peripheral edge surface bound by the top surface and the bottom surface, the peripheral edge surface having a maximum width defined by the linear distance between a first point on the peripheral edge surface to an opposite second point on the peripheral edge surface, a top surface and a bottom surface, the third plate at a top position, the fourth plate at a bottom position, and the intermediate plates stacked between the third plate and the fourth plate;

(c) a spacer separating the first group of plates from the second group of plates;

(d) each plate having a first compressed state wherein the maximum width is smaller than the diameter of the casing;

(e) each plate being formed from a mineral substance, the substance having the property of swelling into a second expanded state upon contact with a liquid and absorption of the liquid; and (f) means for placing the first group, the second group, and the spacer within the casing.

46. The apparatus of claim 45 wherein the means for placing the first group, the second group, and the spacer within the casing comprises a coiled tubing string.

47. The apparatus of claim 45 wherein the spacer comprises a plurality of plates comprising fuller's earth.

48. The apparatus of claim 45 wherein the spacer comprises a plurality of plates comprising Portland cement.

49. The apparatus of claim 45 wherein the spacer comprises a plurality of plates comprising silica sand.

50. The apparatus of claim 45 wherein the spacer comprises a plurality of plates comprising mica.

51. The apparatus of claim 45 wherein the spacer comprises a plurality of plates comprising diatomaceous earth.

52. An apparatus for sealing a deviated segment of a well bore comprising;

(a) a first round plate, a second round plate, and a plurality of intermediate round plates, each plate having a top surface and a bottom surface, the first plate at a top position, the second plate at a bottom position, and the intermediate plates stacked between the first plate and the second plate;

(b) each plate having a first compressed state wherein the plate has a diameter smaller than the diameter of the deviated portion of the well bore;

(c) each plate being formed from a mineral substance, the substance having the property of swelling into a second expanded state upon contact with a liquid and absorption of the liquid; and (d) means for placing the first plate, the second plate and the plurality of intermediate plates within the deviated segment of the well bore.

53. The apparatus of claim 52 wherein the top surface and bottom surface of each plate are centered relative to a vertical axis.

54. The apparatus of claim 53 wherein each plate has a bore extending from the top surface to the bottom surface, the bore centered relative to the vertical axis.

55. The apparatus of claim 54 wherein the means for placing the plates within the deviated segment of the well bore comprises a mandrel inserted through the bore of each plate, wherein the mandrel is connected to a string of tubing.

56. The apparatus of claim 54 wherein the means for placing the plates within the deviated segment of the well bore comprises a mandrel inserted through the bore of each plate, wherein the mandrel is connected to a string of sucker rods.

57. The apparatus of claim 54 wherein the means for placing the plates within the deviated segment of the well bore comprises a mandrel inserted through the bore of each plate, wherein the mandrel is connected to a coiled tubing string.

58. A method of sealing a deviated segment of a well bore comprising the steps of:

(a) disposing a mineral substance into a mold, the substance having the property of swelling upon contact with a liquid and absorption of the liquid;

(b) molding the mineral substance into a first plate, a second plate, and a plurality of intermediate plates, each plate having a top surface, a bottom surface, and a peripheral edge surface bound by the top surface and the bottom surface, the peripheral edge surface having a maximum width defined by the linear distance between a first point on the peripheral edge surface to an opposite second point on the peripheral edge surface;

(c) compressing the first plate, the second plate and the intermediate plates into a first compressed state wherein the maximum width of each plate is smaller than the diameter of the deviated segment of the well bore;

(d) assembling the first plate at a top position, the second plate at a bottom position, and the plurality of intermediate plates stacked between the first plate and the second plate;

7 (e) placing the plates into the deviated segment of the wellbore with placement means; and (f) exposing the plates to liquid, whereby the mineral substance swells into a second expanded state upon contact with the liquid and absorption of the liquid.

59. The method of claim 58 wherein the top surface and bottom surface are centered relative to a vertical axis.

60. The method of claim 59 wherein the plate has a bore extending from the top surface to the bottom surface, the bore centered relative to the vertical axis.

61. The method of claim 60 wherein the placement means comprises a mandrel inserted through the bore, the mandrel connected to a tubing string.

62. The method of claim 60 wherein the placement means comprises a mandrel inserted through the bore, the mandrel connected to a coiled tubing string.

63. The method of claim 60 wherein the placement means comprises a mandrel inserted through the bore, the mandrel connected to a string of sucker rods.

* * * * *